US005641101A

United States Patent [19]

Nakayama

[11] Patent Number: 5,641,101

[45] Date of Patent: Jun. 24, 1997

[54] WAIST BAG USABLE AS A BABY HOLDER

[75] Inventor: Kuniko Nakayama, Ogaki, Japan

[73] Assignee: Lucky Industry Company, Ltd., Gifu, Japan

[21] Appl. No.: 594,237

[22] Filed: Jan. 30, 1996

[51] Int. Cl.[6] ..... A61G 1/00

[52] U.S. Cl. ..... 224/159; 224/676

[58] Field of Search ..... 224/159, 158, 224/607, 610, 614, 625, 626, 676, 681, 208, 224

[56] References Cited

U.S. PATENT DOCUMENTS 4,915,277 4/1990 Larreategui ..... 224/159

5,195,666 3/1993 Yamaguchi et al. ..... 224/159

5,492,256 2/1996 Ive ..... 224/159

*Primary Examiner*—Renee S. Luebke

*Attorney, Agent, or Firm*—Armstrong, Westerman, Hattori, McLeland & Naughton

[57] ABSTRACT

A waist bag usable as a baby holder has a bag body, a waist belt, a supporting member disposed in the bag body, and a shoulder strap. The supporting member is detachably fixed to the bag body by a fastening belt. A lower end of the shoulder strap is introduced into the bag body through a mouth formed thereon, and is detachably connected to the bag body by way of a buckle disposed under the supporting member.

9 Claims, 5 Drawing Sheets

WAIST BAG USABLE AS A BABY HOLDER

BACKGROUND OF THE INVENTION

1. Field of the Invention

The present invention relates to a waist bag usable as a baby holder.

2. Description of the Related Art

Conventional waist bags of this kind are known to the public, as disclosed in U.S. Pat. No. 5,195,666 ('U.S. Pat. No. 5,195,666'), Japanese Laid Open Patent H2-124107 ('JP H2-124107') and Japanese Laid Open Utility Model H1-177061 ('JU H1-177061').

This kind of waist bag comprises a bag body reinforced with a rigid plate core disposed under a top sheet of the bag body, a waist belt secured to the waist bag to be fastened to a use's waist and a shoulder strap connected to the bag body. When a user fastens the waist belt to his or her waist and suspends the shoulder strap from his or her shoulder or neck, this waist bag also serves as a baby holder allowing a baby to sit on the top sheet.

It is, however, noted that certain drawbacks are inherent in those waist bags usable as baby holders, as will be detailed below.

The waist bag disclosed in the U.S. Pat. No. 5,195,666 comprises a rigid plate core horizontally disposed under the top sheet of the bag body. The weight of a baby seated on the bag body is supported by the plate core, which consequently exerts a considerable load to the waist of the user. Therefore, it is not comfortable for the user to continuously use the waist bag for a long time as a baby holder.

Such an uncomfortableness may be relieved to a certain extent in the waist bags shown in JP H2-124107 or JU H1-177061, wherein the waist bag comprises a seat member L-shaped in cross-section having a vertical waist pad and a horizontal plate integrally connected thereto.

This type of waist bag, however, still involves a problem when used as a normal waist bag without utilizing a function as a baby holder. That is, when used as a normal waist bag, the shoulder strap is placed in a bag body through an opening formed on a front portion of the bag body. In addition, the bag body contains a seat member in it as mentioned above. As a result, the inner space of the bag body becomes insufficient to accommodate small articles.

SUMMARY OF THE INVENTION

An object of the present invention is therefore to provide a waist bag usable as a baby holder which is improved in its baby-support stability and which can serve as a normal waist bag when it is not used as a baby holder.

To attain the foregoing, a waist bag usable as a baby holder according to the present invention comprises a bag body, a waist belt, a supporting member disposed in the bag body, and a shoulder strap. The bag body includes a top sheet, a front sheet and a rear sheet. The waist belt is secured to the bag body for fixing the bag body to a user's waist. The supporting member comprises a seat portion extending along the top sheet and a waist portion extending along the rear sheet, and is detachably fastened by a fastening belt fixed to an inside of the bag body. The shoulder strap is capable of being suspended from the user's shoulder or neck when the user holds a baby seated on the bag body. The shoulder strap has a lower end introduced into the bag body through a mouth formed on the front sheet. The lower end of the shoulder strap is detachably connected to the bag body by way of a buckle disposed under the supporting member.

The supporting member may be of an integral reverse L-shaped type consisting of the waist portion depending from a rear edge of the seat portion so as to distribute load.

A skirt portion covering a front edge of the seat portion may preferably be formed so as to extend downward from a front periphery of the top sheet so that the skirt portion can prevent the seat portion from being slipped out from the bag body.

An inner cover is preferably provided in the bag body so as to prevent the member from being observed when the mouth is opened.

Other objects and features will be apparent from the following detailed description of the invention with reference to the attached drawings.

BRIEF DESCRIPTION OF THE DRAWINGS

The present invention will be more fully described and better understood from the following description, taken with the appended drawings, in which.

DETAILED DESCRIPTION OF THE PREFERRED EMBODIMENT

Figure 1:
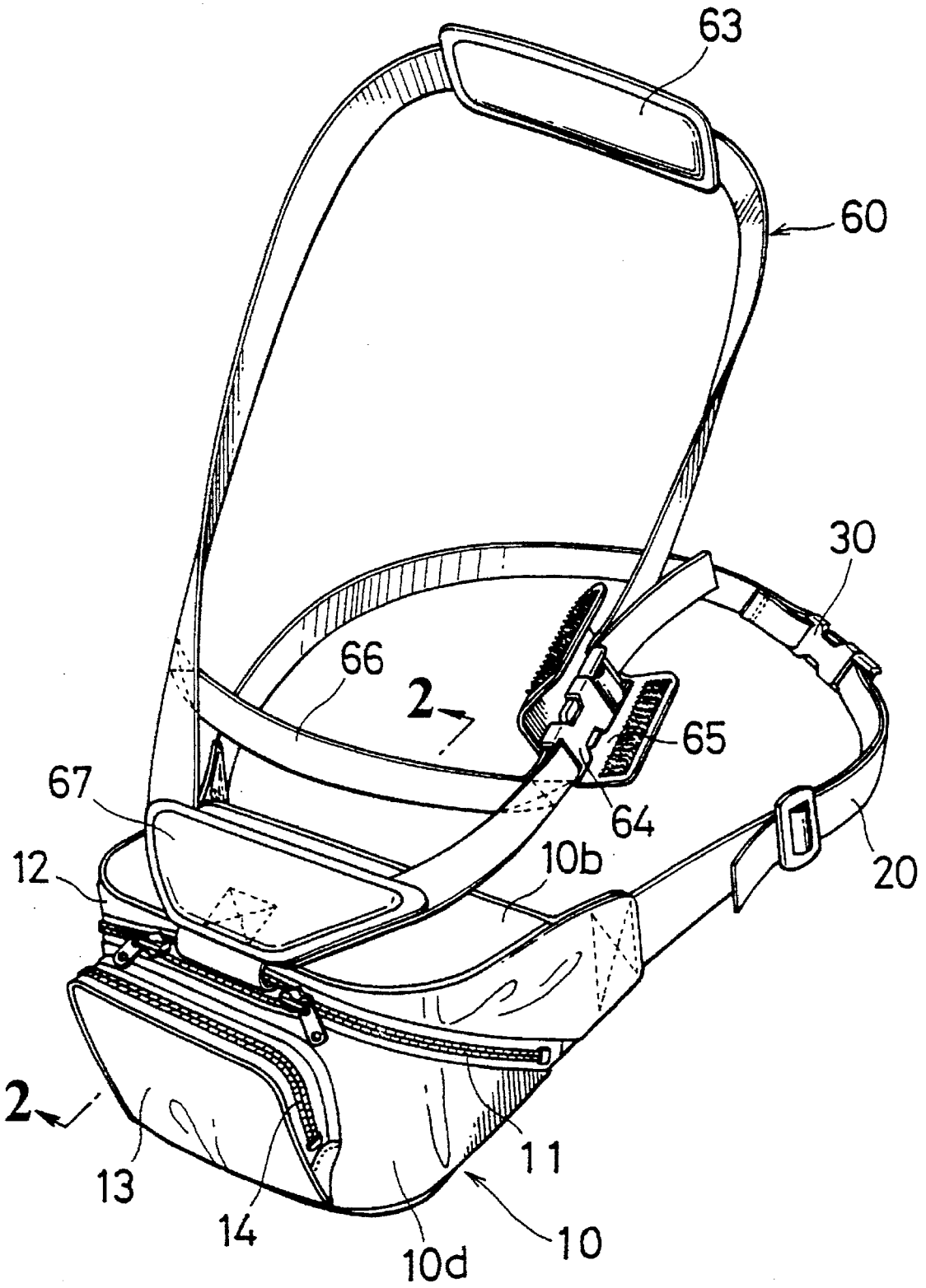
FIG. 1 is a perspective view of a waist bag usable as a baby holder, shown in its entirety, in a preferred embodiment according to the present invention.

A preferred embodiment of the present invention will now be described, in detail, with reference to the accompanying drawings.

FIGS. 1 to 4 show a waist bag usable as a baby holder, wherein reference numeral 10 denotes a bag body having opposite sides secured to a waist belt 20 which will be fastened to a user's waist. The waist belt 20 is adjustable in length, and has a buckle 30, or the like, operable to wear or take off this waist bag.

The bag body 10 is composed of a rear sheet 10*a* which is rectangular and longer in a sideways direction, top and bottom sheets 10*b* and 10*c* which extend from upper and lower edges of the rear sheet 10*a*, respectively, and a front sheet 10*d* which defines front and side faces of the bag body 10. A front portion of the bag body 10 protrudes convexly forward.

Figure 2:
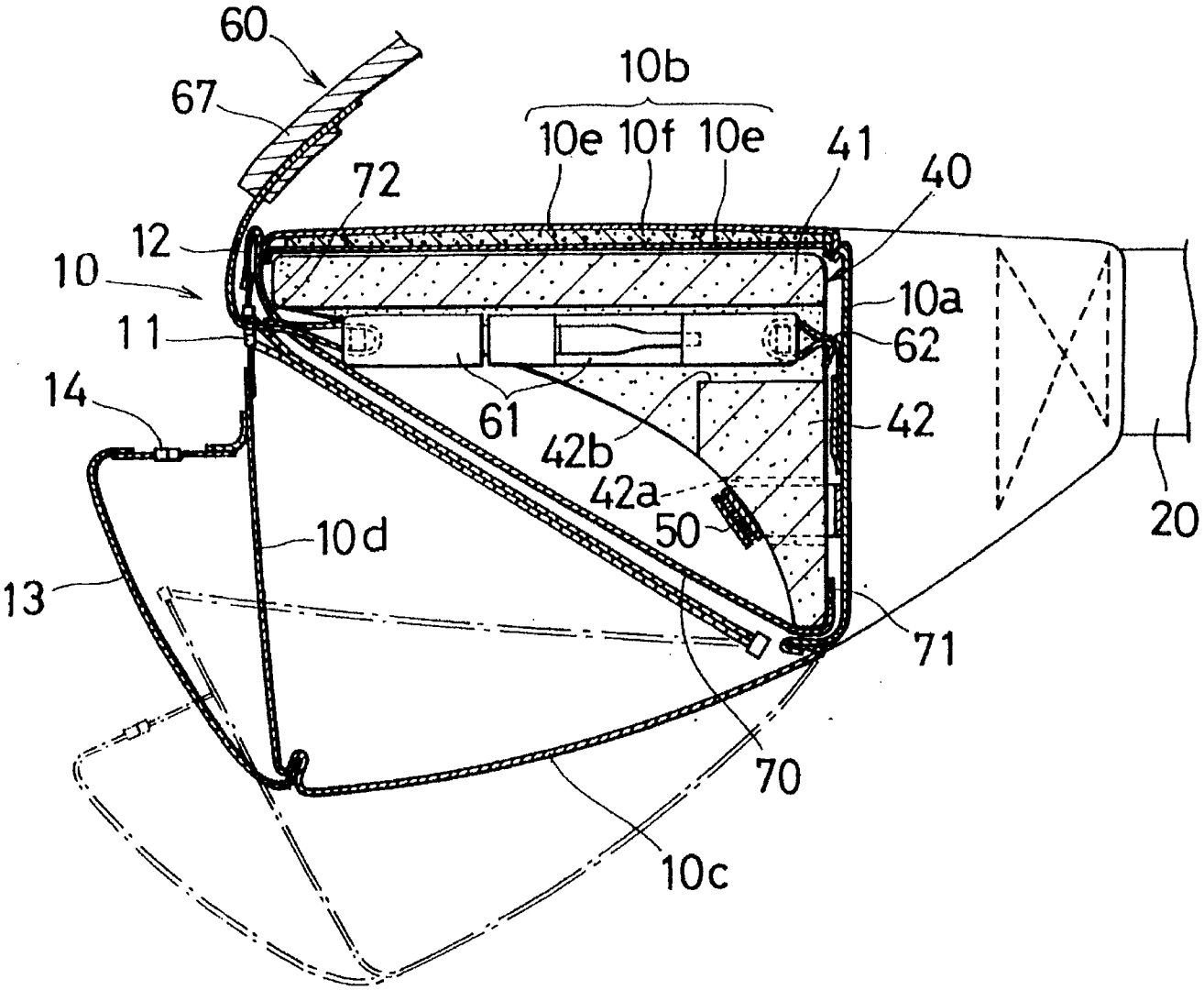
FIG. 2 is an enlarged cross-sectional view taken along the line 2—2 in FIG. 1.

As shown in FIG. 2, the top sheet 10*b* comprises a pair of upper and lower sheets 10*e*, 10*e* and a cushiony thin sheet 10*f* interposed therebetween. A supporting member 40 for supporting the weight of a baby seated on the top sheet 10*b* is disposed in the bag body 10.

Figure 5:
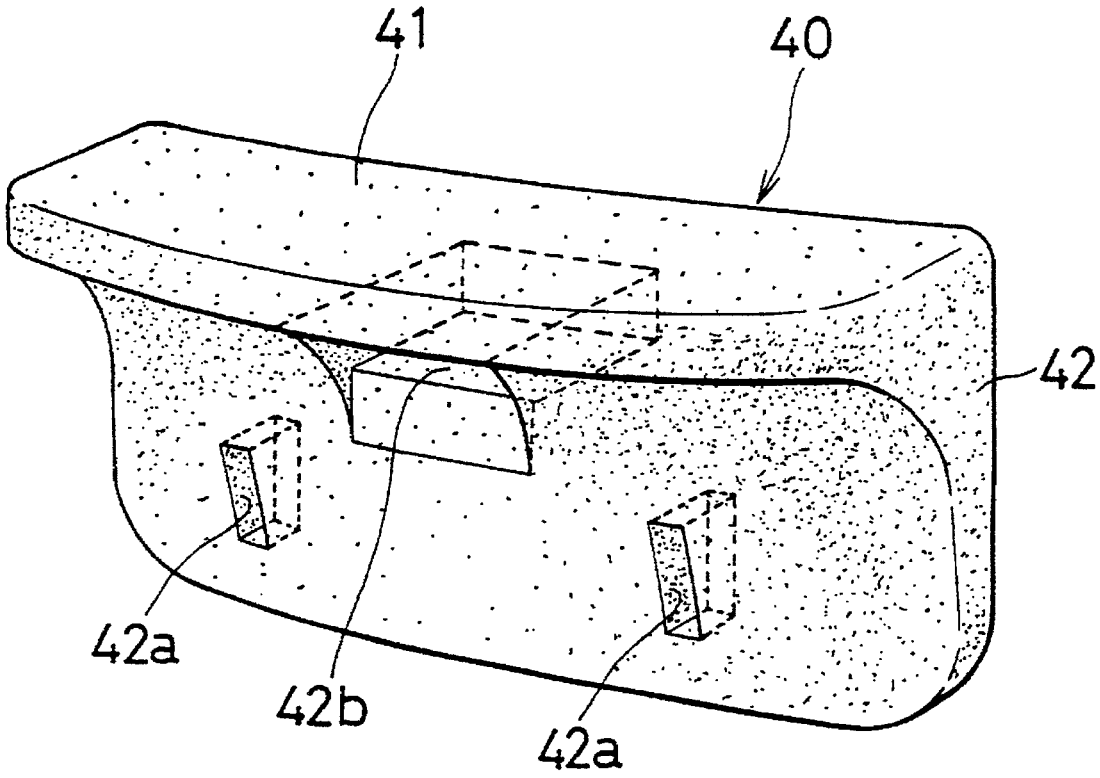
FIG. 5 is a perspective view of a supporting member.

The supporting member 40 comprises a seat portion 41 and a waist portion 42 formed integrally therewith so as to be of a generally reversed L-shape in cross-section. As shown in FIG. 5, a pair of belt-insertion apertures 42*a*, 42*a* having a vertical rectangular shape in cross-section are formed through lower right and left sides of the waist portion 42 in a direction of the thickness. Another buckle-insertion aperture 42*b* having a horizontal rectangular shape in cross-section is formed through an upper central portion between the belt-insertion apertures 42*a*, 42*a* such that the upper inner surface of the aperture 42*b* extends to a lower front edge of the seat portion 41, as shown in FIGS. 2 and 5. The supporting member 40 is made of a hard polystyrol foam or the like plastics and can be easily made by an injection process, for example.

Figure 3:
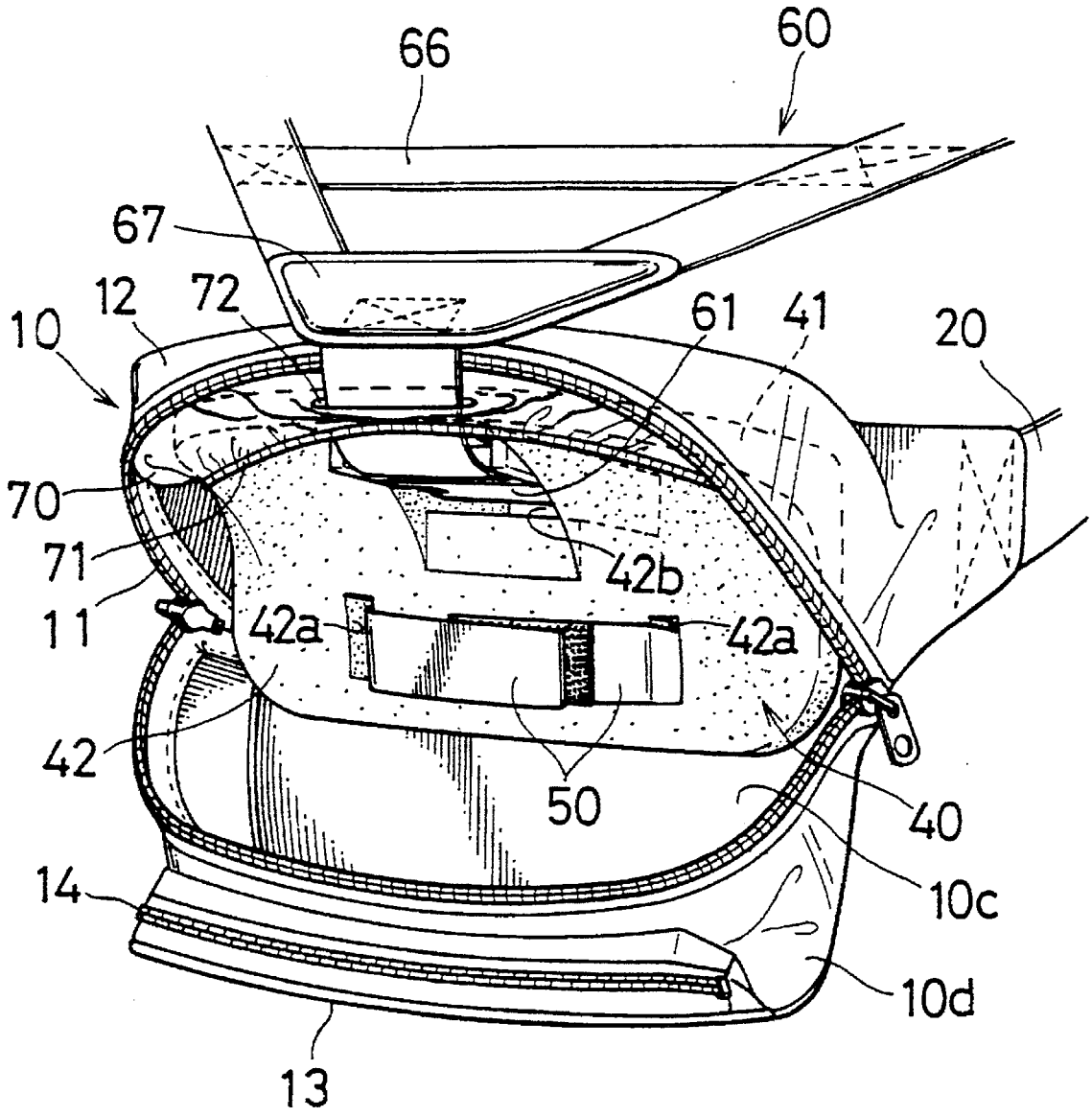
FIG. 3 is a perspective view of the bag body showing the inside through the mouth by turning up the inner cover.

As shown in FIG. 2, the supporting member 40 is disposed in the bag body 10 such that the seat porion 41 and the waist portion 42 extend along the top and rear sheets 10*b* and 10*a*, respectively. The supporting member 40 is detachably fastened to the bag body 10 by a fastening band 50, as shown in FIGS. 2 and 3. The band 50 has a central portion fixed to a lower central portion of the rear sheet 10*a* and lateral end portions passed through corresponding band-insertion apertures 42*a* and 42*a*. Both lateral end portions of the fastening band 50 are overlapped and detachably fastened by flat-shaped fastening members 51, 51 fixed on corresponding surfaces of the lateral end portions so as to steadly hold the supporting member 40 in the bag body 10. Although, in the preferred embodiment, only one fastening band 50 is provided to hold the supporting member 40, two or more fastening bands can also be provided.

A main mouth 11 which is closable with a zipper is formed in a front portion of the bag body 10, as shown in FIG. 1. The mouth 11 is arch-shaped and has a central region formed in an upper middle portion of the front sheet 10*d*. Side or feet regions of the mouth 11 extend from the central region toward lower and rear ends of the opposite sides of the bag body 11. Each side region of the mouth terminates at a location close to a boundary between the front sheet 10*d* and the rear sheet 10*a*. Such a design of the mouth 11 is advantageous in that when the zipper is unfastened, the front sheet 10*d* can swing almost entirely together with the bottom sheet 10*c* backward and downward about a rear end thereof, as shown with phantom lines in FIG. 2, whereby the mouth 11 opens wide. Thus, a shoulder strap 60 and/or small articles can be easily taken in and out.

The bag body 10 has a skirt portion 12 extending downward from the front periphery of the top sheet 10*b* for covering the front edge of the seat portion 41. The skirt portion 12 prevents the support member 40 from slipping out of the bag body 10 when the waist bag is used as a baby holder, thus the bag body 10 can stably sustain the weight of a baby seated thereon.

A pocket 13 for accommodating small articles is provided on the front face of the front sheet 10*d*. A mouth 14 is formed at the top of this pocket, and the mouth 14 is also operably closed with a zipper. The pocket 13 may be designed larger than that shown in the drawings, such that an area of the front sheet 10*d* located below the main mouth 11 is covered by the pocket. In this case, the pocket's mouth 14 will extend in parallel with the main mouth 11.

Figure 4:
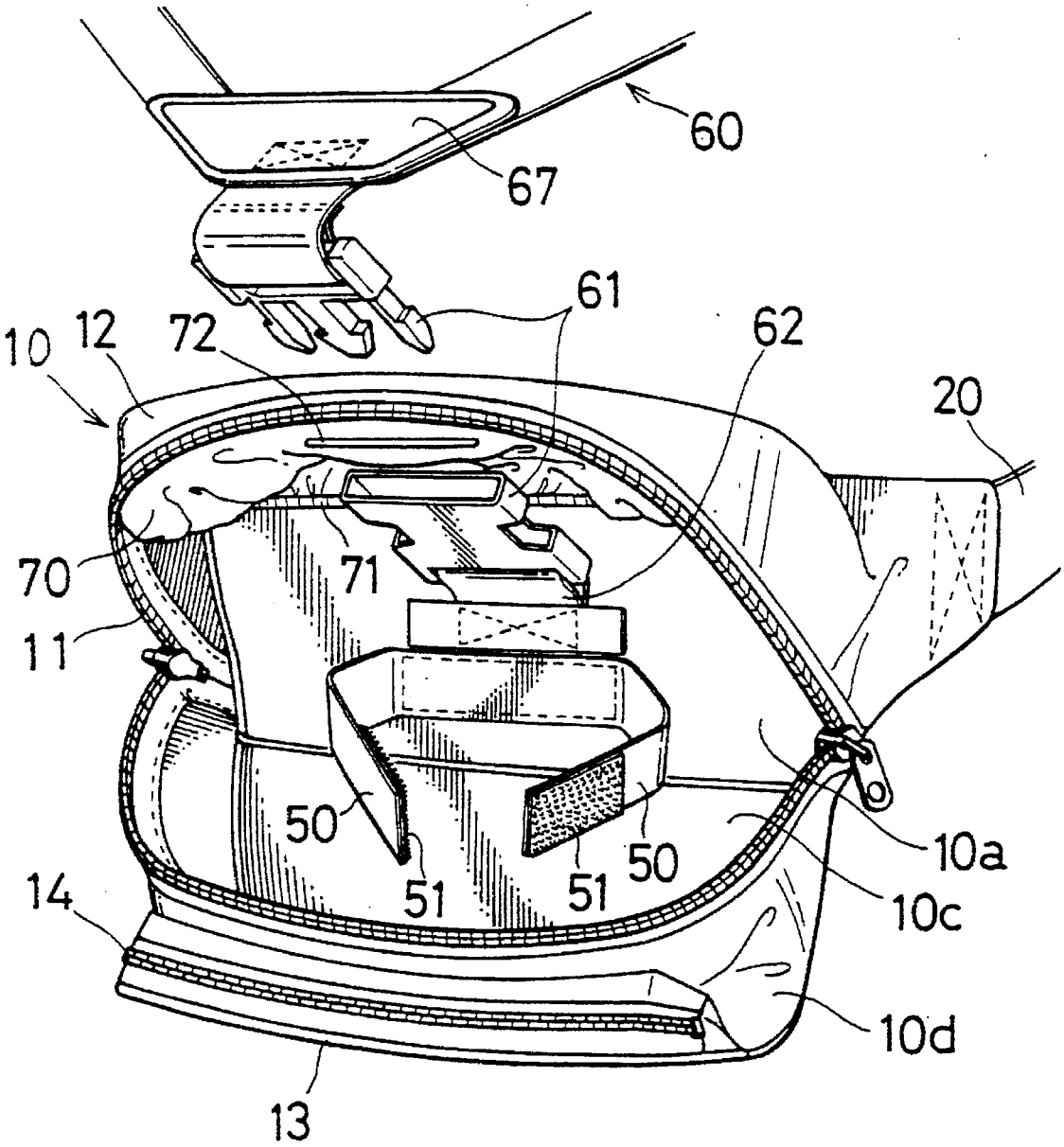
FIG. 4 is a perspective view of the bag body showing the inside through the mouth with the shoulder strap detached and with the supporting body taken out.

Further connected to the bag body 10 is a shoulder strap 60 which will be suspended from a user's shoulder or neck so that the user can hold a baby in its safe position. The shoulder strap 60 has a loop-shaped upper portion and a Y-shaped lower end. The lower end is connected to one half of a detachable buckle 61, as shown in FIG. 4. The other half of the buckle 61 is disposed in the buckle-insertion aperture 42*b* and fixed to the rear sheet 10*a* by way of a belt 62, as shown in FIGS. 2 and 4. The one half of the buckle 61, secured to the lower end of shoulder strap 60, is introduced into the bag body 10 through the central region of the main mouth 11, and is detachably connected to the other half of the buckle 61.

As described above, the lower end of the shoulder strap 60 is introduced into the bag body 10 by way of the front edge of the seat portion 41, and is connected to the rear sheet 42 through the buckle 61 placed under the seat portion 41 and the belt 62. As a result, the weight of a baby seated on the bag body 10 is supported by the combination of the lower end of the shoulder strap 60, the seat portion 41 and the buckle 61, whereby improving the baby-support stability.

The reference numeral 63 denotes a shoulder pad attached to the shoulder strap 60. The shoulder strap 60 further has a buckle 64, a protection band 65 for wrapping the buckle, an auxiliary strap 66 and a backing 67.

Within the bag body 10, is an inner cover 70 which covers a front surface of the supporting member 40. The upper periphery of the cover 70 is sewed to the inner upper portion of the skirt portion 12, and the rest of the periphery, namely lower periphery of the cover 70, is provided with a rubber belt 71. The cover 70 extends over the supporting member 40 by hanging the lower end portion of the cover 70 on the lower edge of the waist portion 42. An upper central portion of the inner cover 70 has an aperture 72 through which the lower end of the shoulder strap 60 is introduced into the bag body 10. The aperture 72 should be large enough so that the one half of the buckle 61 secured to the lower end of the shoulder strap 60 can pass therethrough.

In the use of the waist bag usable as a baby holder provided herein, the user will first fix the waist belt 20 to his or her waist before sitting a baby down on the bag body 10 in a forward- or rearward-directed position. The user will then suspend the shoulder strap 60 from his or her shoulder or neck to hold the baby in safe position.

The weight of the baby will be loaded in part on the user's waist portion in which the waist portion 42 of the seat member 40 is in contact. The load will further be borne partially by the periphery of the user's waist through the waist band 20 and also partially by the shoulder or neck through the shoulder strap 60, thus distributing the load of baby's weight.

Although, in the described preferred embodiment, the supporting member 40 is of an integral type consisting of the seat portion 41 and the waist portion 42, the supporting member may be separately composed of a seat member and a waist member. Such a separate type supporting member is preferable for a broader distribution of load. This is, the seat member can be allowed to move a little relative to the waist member so as to fit on the user's physical figure, whereby load concentration on a narrow region of the user's waist can be avoided, rendering the waist bag comfortable in use to hold a baby.

When the waist bag is used as a normal waist bag, namely when it is unnecessary for the user to carry his or her baby, the shoulder strap 60 can be placed in the bag body 10 through the main mouth 11. In this state, however, the space of the waist bag for accommodating small articles is limited because of the occupied shoulder strap 60 and supporting member 40. In the waist bag according to the present invention, the shoulder strap 60 can be detached from the bag body 10 by disconnecting the buckle 61, and the supporting member 40 can also be taken out from the bag body 10 by unfastening the fastening band 50. As a result, the bag body 10 has enough space for accommodating small articles.

In summary, the waist bag provided herein comprises a bag body in which the supporting member is disposed and detachably fixed by a fastening band and a shoulder strap detachably connected to the bag body. Therefore, when it is unnecessary for the user to carry his or her baby, the shoulder strap may be placed in the bag body, so that the bag can be used as an ordinary waist bag. Alternatively, the shoulder strap may be detached from the bag body and the supporting member can also be taken out form the bag body, so that the inner space of the bag body can be fully used as an accommodating space for small articles.

Further, because the lower end portion of the shoulder strap is introduced into the bag body through the main mouth, and is connected to the buckle which is disposed under the seat portion of the supporting member, the weight of a baby seated on the bag body can be firmly supported by the combination of the lower end portion of the shoulder strap, the seat portion of the supporting member and the buckle.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. A waist bag usable as a baby holder, comprising:

a bag body having a top sheet, a front sheet and a rear sheet;

a waist belt secured to said bag body for fixing said bag body to a user's waist;

a supporting member disposed in said bag body for supporting a weight of a baby seated on said bag body; and a shoulder strap capable of being suspended from the user's shoulder or neck when the user holds a baby seated on said bag body;

wherein said supporting member includes a seat portion extending along said top sheet and a waist portion extending along said rear sheet, said supporting member being detachably fastened by a fastening belt secured to said bag body, and wherein said shoulder strap has a lower end introduced into said bag body through a mouth formed on said front sheet, said lower end being detachably connected to said bag body by way of a buckle disposed under said supporting member.

2. A waist bag as recited in claim 1, wherein said supporting member is of a reversed L-shape in cross-section consisting of said seat portion integral with said waist portion.

3. A waist bag as recited in claim 2, wherein said supporting member is provided with a buckle-insertion aperture formed through an upper central portion of said supporting member so that said buckle can be disposed under said seat portion.

4. A waist bag as recited in claim 1, wherein said supporting member is of a generally reversed L-shape in cross-section, and said buckle is disposed under said seat portion, and wherein one half of said buckle is connected to said lower end of said shoulder strap and another half of said buckle is connected to said rear sheet.

5. A waist bag as recited in claim 1, wherein said bag body has a skirt portion extending downward from a front periphery of said top sheet so as to cover a front edge of said seat portion.

6. A waist bag as recited in claim 1, further comprising an inner cover concealing a front surface of said supporting member.

7. A waist bag usable as a baby holder, comprising:

a bag body having a top sheet, a front sheet and a rear sheet;

a waist belt secured to said bag body for fixing said bag body to a user's waist;

a supporting member disposed in said bag body for supporting a weight of a baby seated on said bag body;

a shoulder strap capable of being suspended from the user's shoulder or neck when the user holds a baby seated on said bag body;

a skirt portion extending downward from a front edge of said top sheet so as to cover a front edge of said seat portion;

wherein said supporting member comprises a seat portion extending along said top sheet and a waist portion extending along said rear sheet, said supporting member being detachably fastened by a fastening belt secured to said bag body, and said seat portion being integral with said waist portion so as to be of a reversed L-shape in cross-section; and wherein said shoulder strap has a lower end introduced into said bag body through a mouth formed on said front sheet, said lower end being detachably connected to said bag body by way of a buckle disposed under said supporting member.

8. A waist bag as recited in claim 7, wherein said supporting member is provided with a buckle-insertion aperture formed through an upper central portion of said supporting member so that said buckle can be disposed under said seat portion.

9. A waist bag as recited in claim 8, wherein said buckle is disposed in said buckle-insertion aperture, and wherein one half of said buckle is connected to said lower end of said shoulder strap and the other half of said buckle is connected to said rear sheet.

* * * * *